United States Patent [19]

Shimomura et al.

[11] Patent Number: 5,027,773

[45] Date of Patent: Jul. 2, 1991

[54] CONTROL DEVICE FOR AN INTERNAL COMBUSTION ENGINE

[75] Inventors: Setsuhiro Shimomura, Himeji City; Shoichi Washino, Amagasaki City, both of Japan

[73] Assignee: Mitsubishi Denki Kabushiki Kaisha, Tokyo, Japan

[21] Appl. No.: 402,580

[22] Filed: Sep. 5, 1989

[30] Foreign Application Priority Data

Sep. 5, 1988 [JP] Japan ..... 63-221914

[51] Int. Cl.[5] ..... F02D 41/14; F02P 5/15

[52] U.S. Cl. ..... 123/425; 123/422; 123/435; 123/492

[58] Field of Search ..... 123/425, 435, 422, 423, 123/492, 493

[56] References Cited

U.S. PATENT DOCUMENTS 4,190,027 2/1980 Inui et al. ..... 123/425
4,417,556 11/1983 Latsch ..... 123/425
4,625,690 12/1986 Morita ..... 123/425

FOREIGN PATENT DOCUMENTS 62-85148 4/1987 Japan .
63-55341 3/1988 Japan ..... 123/435
63-65157 3/1988 Japan ..... 123/435

*Primary Examiner*—Andrew M. Dolinar
*Attorney, Agent, or Firm*—Sughrue, Mion, Zinn, Macpeak & Seas

[57] ABSTRACT

A control device for an automotive engine provided with a fuel injection valve determines the current value of a parameter (e.g. the mean effective combustion pressure) indicative of the output power of the engine, and compares it to the target value thereof determined, for example, from the temporal change of the throttle opening degree. At least one of the parameters: the driving pulse width of the fuel injection valve (corresponding to the amount of fuel supply), the ignition timing, and the amount of intake air, is selected as a manipulated variable and controlled so as to reduce the difference between the current and target values of the parameter.

4 Claims, 6 Drawing Sheets

CONTROL DEVICE FOR AN INTERNAL COMBUSTION ENGINE

BACKGROUND OF THE INVENTION

This invention relates to control devices for internal combustion engines wherein the amount of fuel supply, ignition timing, etc., are adjusted during the transient accelerated or decelerated state of the engine.

Control devices for internal combustion engines are now commonly used in which the appropriate amount of fuel supply and ignition timing are calculated on the basis of the relationship between the amount or pressure of the intake air and the rpm (revolutions per minute) of the engine, and the fuel injection valve and the ignition device are controlled accordingly. Further, Japanese laid-open patent application No. 62-85148 proposes a control device in which for the purpose of accomplishing a high precision control, the combustion pressure within the cylinders of the engine is detected so that it is adjusted to a target value thereof; in this type of the control device, the combustion state of the engine is detected by the combustion pressure sensors disposed on respective cylinders, and the fuel injection timing and the EGR (exhaust gas recirculation) valve are controlled such that the combustion state of the engine approaches a predetermined pattern.

This type of control device for internal combustion engines, however, has the following disadvantage: The fuel injection timing and the EGR ratio utilized as the manipulated variables in this type of device are effective for controlling the combustion pressure only over a small range thereof. In the case of automotive engines, however, the operating state of the engine often undergoes rapid changes over a wide range; thus, when, for example, the engine is rapidly accelerated, the engine is deviated from its optimum combustion state.

SUMMARY OF THE INVENTION

The primary object of this invention is therefore to provide a control device for an internal combustion engine which exhibits sufficient controllability even during the transient state of the engine, and the change of the combustion state is controlled according to an optimum pattern so as to obtain a smooth accelerating and decelerating performance of the engine.

The above object is accomplished according to the principle of this invention in a control device for an internal combustion engine wherein at least one of the following is selected as the manipulated variable or variables: the amount of fuel supply (which corresponds to the driving pulse width of the fuel injection valve in the case of an engine provided with a fuel injector); the ignition timing; and the amount of intake air. The current value of a parameter indicative of the output power of the engine, which parameter is calculated from the combustion pressure within the cylinders of the engine, is compared with a target value thereof which is determined, for example, from the change rate of the opening degree of the throttle valve of the engine. The manipulated variable or variables are controlled to reduce the difference between the current and target values of the parameter.

Thus, according to this invention, the output power or the combustion pressure of the engine is controlled in each combustion cycle according to a smooth pattern represented by the change of the target value thereof.

As a result, the engine can be smoothly accelerated or decelerated even during the transient state thereof.

BRIEF DESCRIPTION OF THE DRAWINGS

The novel features which are believed to be characteristic of this invention are set forth with particularity in the appended claims. This invention itself, however, both as to its organization and method of operation, together with further objects and advantages thereof, may best be understood by reference to the following detailed description of the preferred embodiment taken in conjunction with the accompanying drawings, in which:

In the drawings, like reference numerals or characters respresent like or corresponding parts, signals, etc.

DETAILED DESCRIPTION OF THE PREFERRED EMBODIMENT

Figure 1:
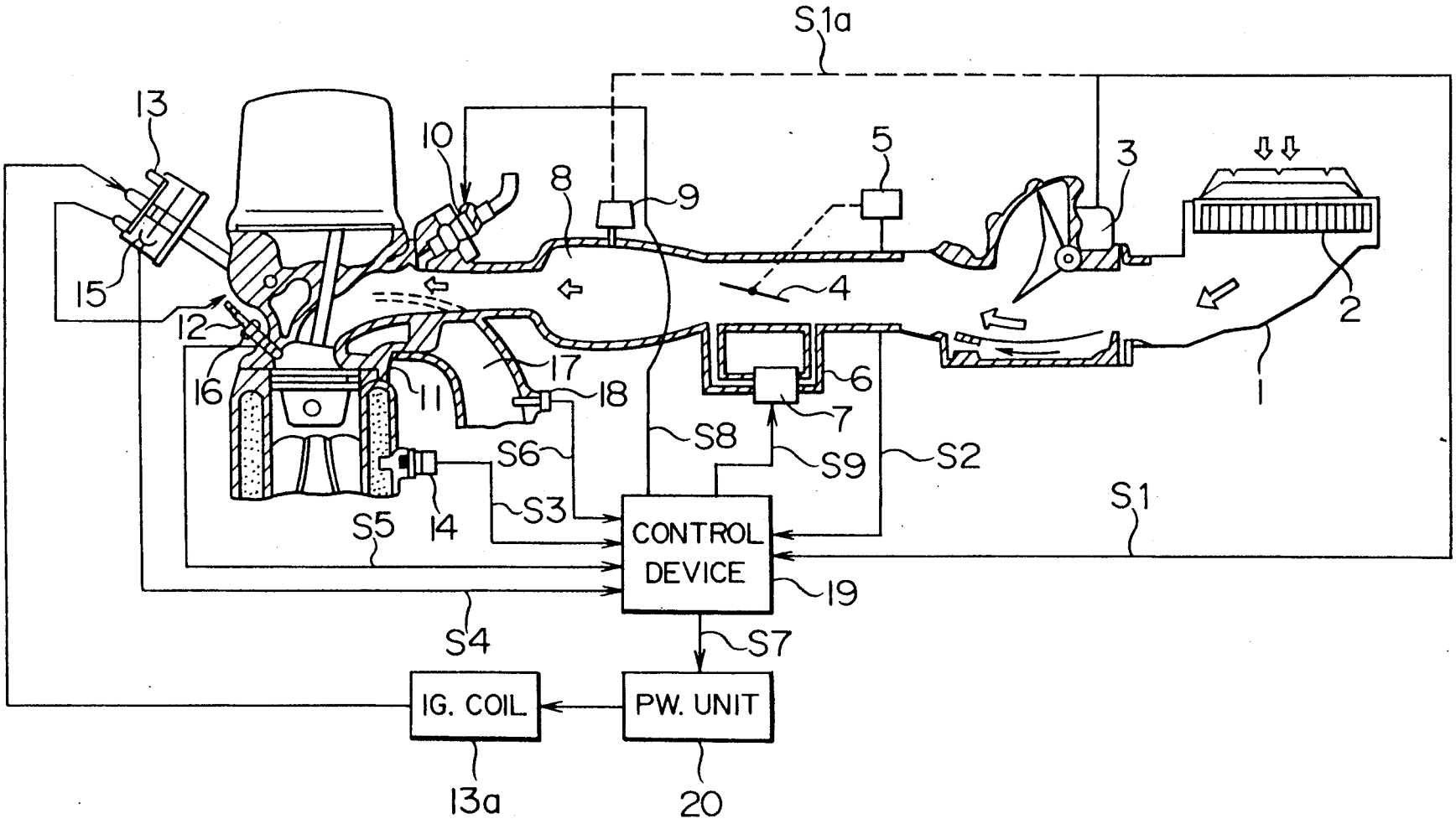
FIG. 1 is a block diagram showing the overall organization of the sensor system of the control device together with the associated engine.

Referring now to the drawings, an embodiment of this invention is described.

Referring first to FIG. 1, let us describe the overall organization of an automotive internal combustion engine which is provided with a control device according to this invention. The air is taken into an air intake pipe 1 through an air cleaner 2 disposed at the air inlet opening of the pipe 1. The amount of intake air, Qa, measured by an air flow meter 3, is controlled primarily by a throttle valve 4, whose rotational position, i.e., degree of opening, is detected by an opening degree sensor 5. A bypass air passage 6 bypassing the throttle valve 4 is provided with a bypass valve 7 which controls the additional amount of intake air bypassed through the bypass passage 6. The air pressure Pb within the air intake manifold 8 is detected by an intake air pressure sensor 9 disposed thereat.

The air thus introduced into the air intake manifold 8 is mixed with the fuel injected from a fuel injection valve 10; the air-fuel mixture thus obtained is supplied to the combustion cylinders within a cylinder block 11 of the main body of the engine; the air-fuel mixture led into each cylinder is ignited and combusted by a spark generated by an ignition plug 12 in response to a high voltage supplied from an ignition coil 13*a* via a distributor 13. A water temperature sensor 14 disposed on the cylinder block 11 detects the temperature of the coolant water within the water jacket of the cylinder block 10. A crank angle sensor 15 disposed at the distributor 13 detects the crank angle $\theta c$ corresponding to the rotational position of the engine; more precisely, it generates, for example, a reference angle pulse at each reference crank angle (i.e., at each 180 degrees in the case of a four cylinder engine; at each 120 degrees in the case of a six cylinder engine) and a unit angle pulse at each unit angle (e.g. at each rotation of 1 degree) of the crank shaft of the engine. Thus, the crank angle $\theta c$ can be determined by counting the number of unit angle pulses generated after a reference angle pulse. On the other hand, the rpm (revolutions per minute) N of the engine can be determined by measuring the frequency or period of the unit angle pulses. Further, a combustion pressure sensor 16 disposed at the base of the ignition plug 12 detects the inner pressure, i.e., the combustion pressure, Pc, within each cylinder of the engine.

The exhaust gas generated by combustion within cylinders of the engine is exhausted from an exhaust manifold 17; an exhaust gas sensor 18 disposed thereat detects the concentration of a component of the exhaust gas (e.g, the oxygen concentration thereof).

The operation of the engine of FIG. 1 is controlled by a control device 19 which outputs, in response to the various sensor signals, the necessary control signals. More specifically, the sensor signals inputted to the control device 19 includes the following: output signal S1 of the air flow meter 3, indicating an intake air amount Qa, or alternatively, signal S1*a* of the pressure sensor 9, indicating the intake air pressure Pb; output signal S2 of the throttle opening degree sensor 5, indicating the opening degree $\alpha$ of the throttle valve 4; output signal S3 of the water temperature sensor 14, indicating the coolant water temperature of the engine; output signal S4 of the crank angle sensor 15, indicating the crank angle $\theta c$ and the rpm N of the engine; output signal S5 of the combustion pressure sensor 16, indicating the inner pressure (i.e., combustion pressure) Pc within the cylinders of the engine; and output signal S6 of the exhaust gas sensor 18, indicating the composition of a component of the exhaust gas. On the basis of these sensor signals inputted thereto, the control device 19 outputs control signals S7, S8, and S9, respectively, to an ignition power unit 20, the fuel injection valve 10, and the bypass valve 7. The control of the ignition timing and that of the fuel injection are effected by means of the ignition timing signal S7 and the fuel injection control signal S8: the power unit 20 amplifies the ignition timing signal S7 outputted from the control device 19, to supply the resulting voltage to the ignition coil 13*a* in synchrony with the ignition timing signal S7; on the other hand, the fuel injection valve 10 is driven in response to the fuel injection control signal S8. The control operations of the ignition timing and the fuel injection effected on the basis of the above sensor signals are well known in the art; thus further description thereof is deemed unnecessary. On the other hand, the control of the bypass valve 7 by means of the control signal S9, which is effected in accordance with the principle of this invention, is described in detail later.

Figure 2:
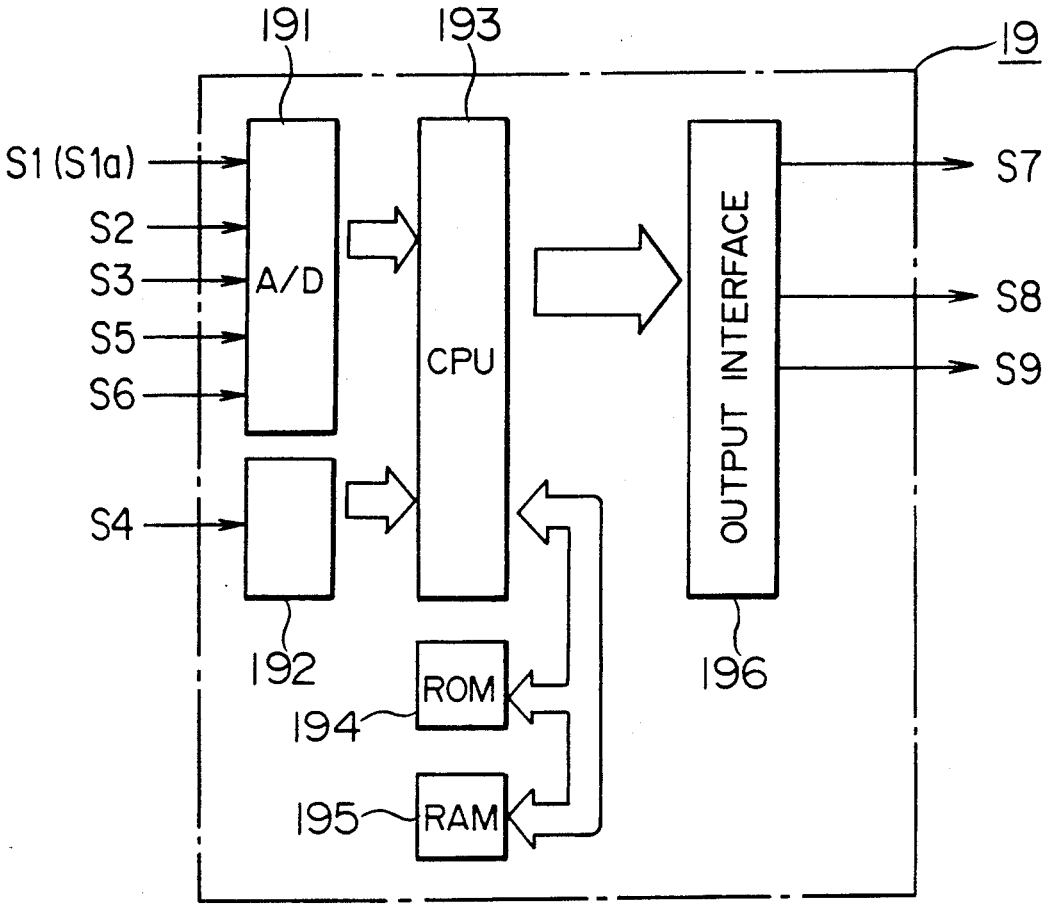
FIG. 2 is a block diagram showing the physical organization of the control device of FIG. 1.

The control device 19 may be constituted by a microcomputer having a physical organization as shown in FIG. 2: an A/D (analog-to-digital) converter 191 converts into corresponding digital signals the analog sensor signals S1 (or S1*a*), S2, S3, S5, and S6; on the other hand, the pulse-shaped crank angle signal S4 is inputted to an input interface 192 provided therefor; a CPU (central processing unit) 193, receiving the sensor signals via the converter 191 and the interface 192, effects various operations according to the predetermined programs and data stored in the ROM (read-only memory) 194 and the temperature data stored in the RAM (random access memory) 195; an output interface 196 outputs the result of these operations of the CPU 193 as the control signals S7 through S9 to the power unit 20, the fuel injection valve 10, and the bypass valve 7.

Figure 3:
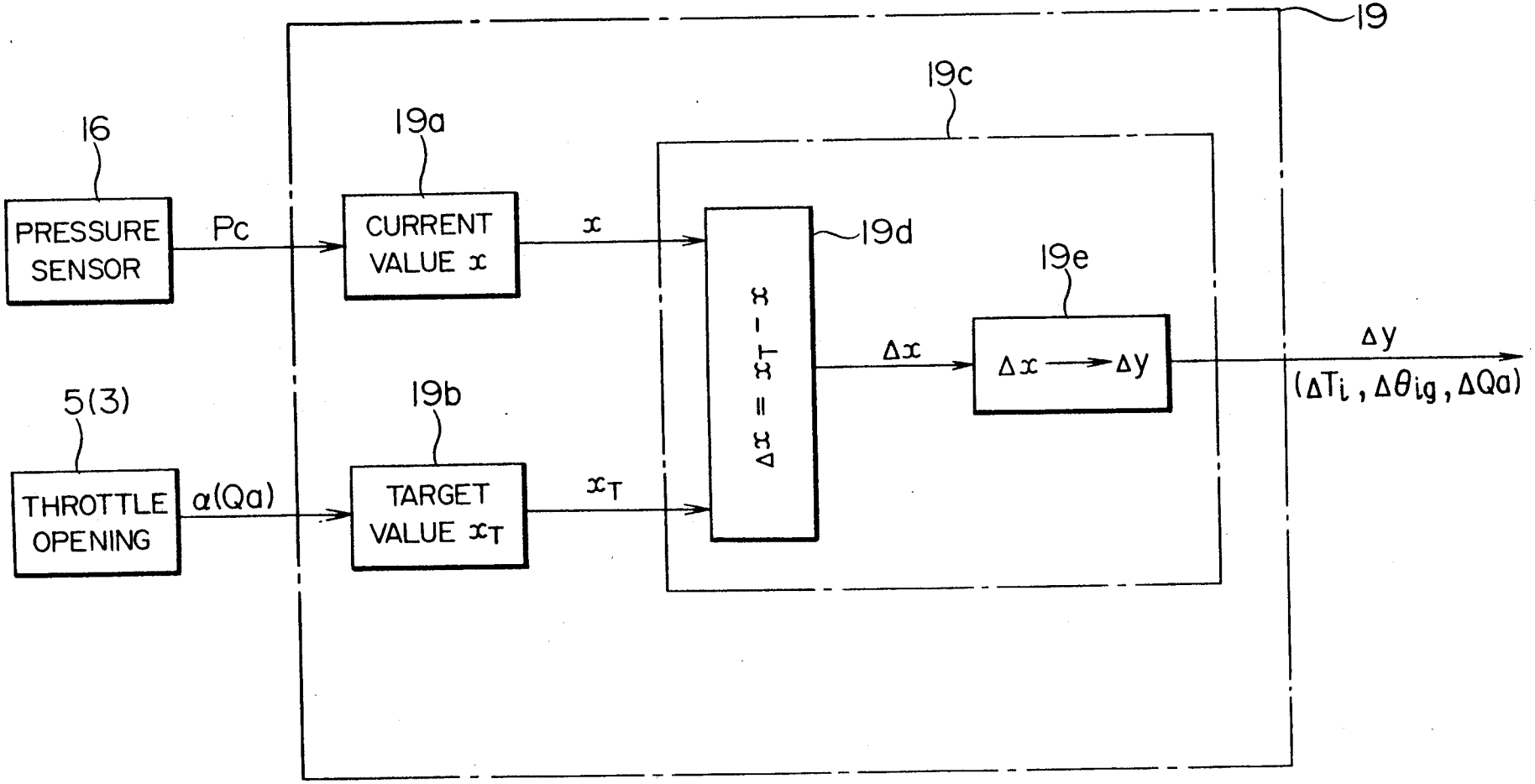
FIG. 3 is a block diagram showing the functional organization of the control device according to the principle of this invention.

Referring to FIG. 3, let us now describe the functional organization and method of operation of the control device 19 according to the principle of this invention. According to this invention, the control device 19 comprises the following means: means 19*a* for calculalting the current value of a parameter x (e.g. the mean effective pressure Pi within the cylinders of the engine) which corresponds to and represents the output power or efficiency of the engine; means 19*b* for calculating the target value $x_T$ of the same parameter x on the basis of the detected transient acceleration state of the engine; and control means 19*c* for determining and adjusting the value of the manipulated variable (or variables) y (which comprises at least one of the three variables: the driving pulse width Ti of the fuel injection valve 10, corresponding to the amount of fuel supplied to the cylinders of the engine; the ignition timing $\theta ig$ of the ignition plug 12; and the amount of intake air Qa through the bypass valve 7) in accordance with the outputs of the above means 19*a* and 19*b*. The adjustment of the manipulated variable (s) y is effected in such a manner that the current value of the parameter x approaches the target value $x_T$ thereof. Thus, according to this invention, the target value $x_T$ which guarantees smooth acceleration of the engine is determined by means 19*b* and the current value of the parameter x calculated by means 19*a* is controlled to follow closely the thus determined target value $x_T$; as a result, the output power of the engine can be adjusted smoothly and quickly to the transient state of the engine. Let us describe in what follows the method of operation of the means 19*a* through 19*c* in greater detail.

Figure 4:
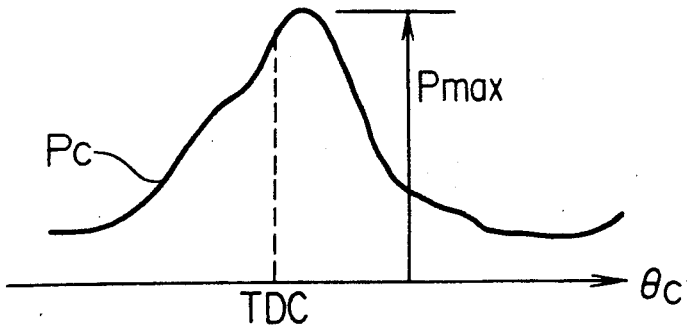
FIG. 4 shows the typical variation curve of the combustion pressure within a cylinder of the engine.

The parameter x calculated by means 19*a* as a value corresponding to the output power of the engine may be the indicated (i.e. graphically indicated and represented) mean effective pressure Pi within the cylinders of the engine; let us describe the method of calculation of the mean effective pressure Pi on the basis of the inner or combustion pressure Pc within the cylinders of the engine (as determined from the output signal S5 of the combustion pressure sensor 16) and the crank angle $\theta c$ (as determined from the output signal S4 of the crank angle sensor 15):

The combustion pressure Pc varies as shown in FIG. 4 with respect to the crank angle $\theta c$; the combustion pressure Pc indicated by the output S5 of the combustion pressure sensor 16 reaches its maximum Pmax just after the top dead center (TDC) during the power stroke of the piston. The indicated mean effective pressure Pi can be calculated by integrating the values of the combustion pressure Pc over a power stroke of each cycle; namely Pi is given by:

$$Pi = (1/Vs) \cdot \int_0^{Vs} Pc \cdot dV$$

wherein dV represents the differential of the inner volume V of the cylinder, and Vs is the displacement volume of the stroke of the piston. The inner volume V of the cylinder is expressed by means of the bore diameter d, connecting rod length 1, the piston stroke $\gamma$, and the crank angle $\theta c$ as follows:

$$V=(\pi/4)\times d^2\times\gamma\{(1-\cos\theta c)+(\gamma/41)(1-\cos 2\theta c)\}$$

On the other hand, the displacement volume Vs of the piston is expressed as follows:

$$Vs=(\pi/4)\times d^2\times\gamma$$

The indicated mean effective pressure Pi as calculated by means of the above equations is well known as a parameter for indicating and detecting the output power of the engine directly.

Instead of the mean effective pressure Pi, the maximal value Pmax of the combustion pressure Pc within the cylinder of the engine or one of the following values A and B may be utilized as the parameter x whose current value is calculated by means 19*a* as an indicator of the engine output power or efficiency:

$$A=Pi/(Qa/N)$$

$$B=Pi/Pb$$

wherein Qa is the amount of intake air determined from the output S1 of the air flow meter 3, N is the rpm of the engine determined from the output S4 of the crank angle sensor 15, and Pb is the intake air pressure determined from the output S1*a* of the intake air pressure sensor 9. These parameters A and B represent the combustion energy extracted from the unit amount of air per one stroke of the engine; hence, they indicate the efficiency of the engine.

Figure 5:
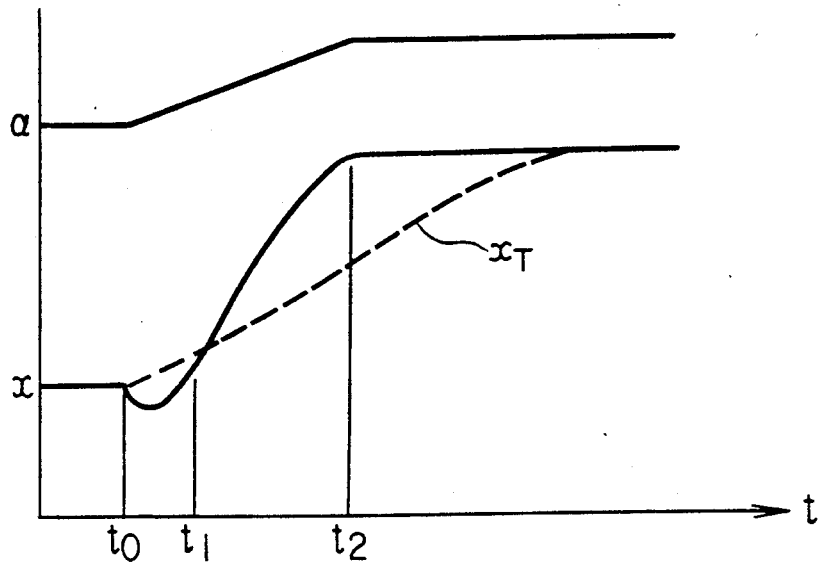
FIG. 5 shows the variation curves, over an acceleration period, of the parameter x indicative of the output power or efficiency of the engine together with that of the opening degree of the throttle valve.

If the control according to this invention is not effected, the parameter x (i.e., the indicated mean effective pressure Pi or the maximal pressure Pmax of the combustion pressure Pc, or the parameter A or B, as defined above) changes with time t or the crank angle $\theta c$ as represented by the solid curve in FIG. 5 (the figure shows time t along the abscissa) when the engine is in an accelerated state. The opening degree $\alpha$ of the throttle valve 4 increases during the period of acceleration between time point $t_0$ and $t_2$, as shown at the top of the same figure. As shown in the figure, after the time point $t_0$ at which the opening degree $\alpha$ of the throttle valve 4 begins to increase, the value of the parameter x first decreases from time point $t_0$ to $t_1$, to increase rapidly thereafter between $t_1$ and $t_2$. This initial decrease of the parameter x often happens when the engine is put in a rapidly transient state, due, for example, to the delay of the fuel supply or the ignition timing control with respect to the rapid change. This initial decrease of the parameter x is indicative of the decrease of the output power of the engine, which not only impairs the accelerating performance of the engine, but also often is accompanied with unpleasant vibrations. Further, the subsequent compensating rapid increase of the parameter x between time points $t_1$ and $t_2$ may cause over-acceleration, which may be accompanied with a mechanical shock or a resonant oscillation of the support system of the engine.

Thus, according to this invention, the means 19*b* of the control device 19 shown in FIG. 3 determines a target value $x_T$ of the parameter x whose value varies as shown by the dotted curve in FIG. 5. The target value $x_T$ increases smoothly so that if the value of the parameter x follows the target value $x_T$, the engine is accelerated without any adverse effects mentioned above; this target value is determined on the basis of the opening degree $\alpha$ of the throttle valve 4 or the amount of the intake air Qa. The actual determination of the target value $x_T$ may be effected as follows: the values of $x_T$ corresponding to the temporal change rate of the opening degree $\alpha$ or the intake air amount Qa are determined beforehand by experiments, etc., and stored in the data table within the ROM 194 (see FIG. 2); the current value of $x_T$ corresponding to the current temporal change rate of $\alpha$ or Qa (as determined from the output signal of the air flow meter 1 or the throttle opening degree sensor 5) is retrieved by means 19*b* from the data table of the ROM 194. Alternatively, the current target value $x_T$ may be calculated by means 19*b* from the current value of $\alpha$ or Qa utilizing a function having a parameter or parameters represented by $\alpha$ or Qa; for example, the target value $x_T$ may be increased according to the sinusoidal function: $x_T=b\cdot\sin at$, wherein t is the time and the parameters a and b are determined in accordance with the change rate of the opening degree $\alpha$ of the throttle valve or the intake air amount Qa. It has been verified experimentally that the acceleration of the engine can be effected smoothly when the parameter x is varied according to the sinusoidal function.

Figure 6:
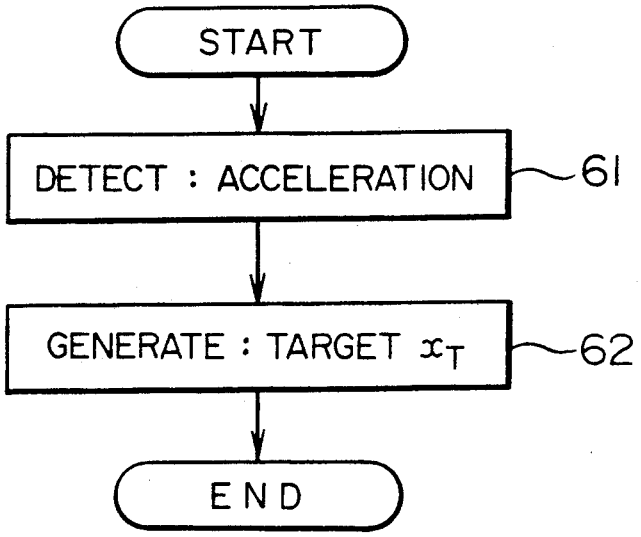
FIG. 6 shows a routine for determining the target value of the parameter x.

FIG. 6 shows the flowchart of the routine which may be followed by the means 19*b* in the determination of the target value $x_T$. At step 61, the acceleration of the engine is detected and determined from the temporal change of the opening degree $\alpha$ of the throttle valve 4 or the temporal change of the intake air amount Qa. At the next step 62, the target value $x_T$ of the parameter x is determined on the basis of the change rate of the opening degree $\alpha$ or the intake air amount Qa determined at the preceeding step 61.

Figure 8:
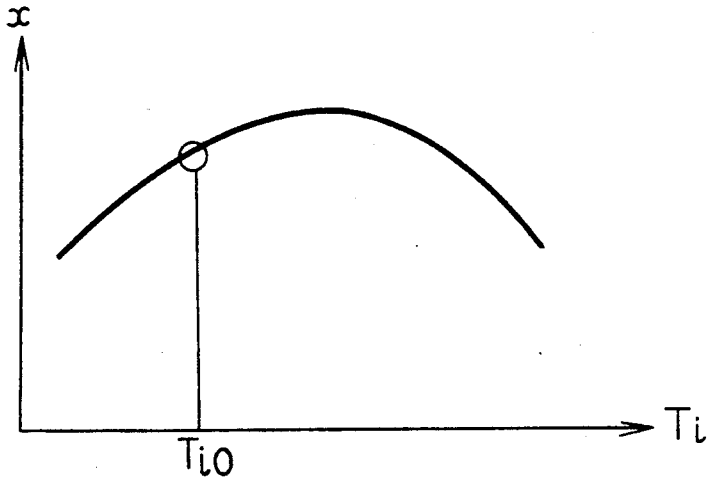
FIGS. 8 and 9 show the relationships between the values of the manipulated variables and the parameter x.
Figure 9:
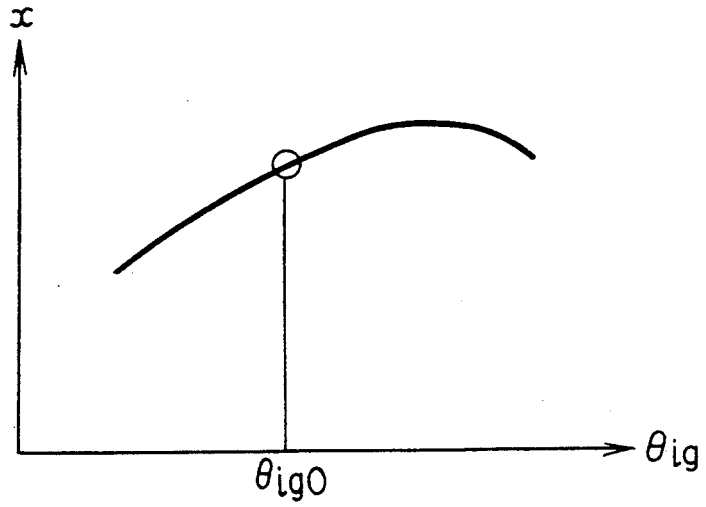

The control means 19*c* of the control device 19 shown in FIG. 3 determines the value of a manipulated variable (or variables) y such that the actual value of the parameter x determined by means 19*a* approaches the target value $x_T$ thereof determined by means 19*b*. The manipulated variable y comprises at least one of the following: the driving pulse width Ti of the fuel injection valve 10, the ignition timing $\theta ig$ of the ignition plug 12, and the intake air amount Qa through the bypass valve 7. The value of the parameter x varies as shown in FIGS. 8 and 9, respectively, with the values of the driving pulse width Ti and the ignition timing $\theta ig$; in both figures, the normal values of the manipulated variables, Ti and $\theta ig$, are shown by the suffix 0 (i.e., by $Ti_0$ and $\theta ig_0$). The value of the parameter x increases or decreases accordingly as the fuel injection driving pulse width Ti is increased or decreased from the normal value $Ti_0$; thus, in the case where the driving pulse width Ti is selected as one of the manipulated variables y, the increment or decrement $\Delta Ti$ of the pulse width Ti is determined in accordance with the difference: $\Delta x=x-x_T$, such that the value of the pulse width Ti is adjusted and controlled so as to reduce the difference $\Delta x$. Similarly, as shown in FIG. 9, the value of the parameter x increases or decreases accordingly as the ignition timing $\theta ig$ is retarded or advanced; thus, in the case where the ignition timing signal is selected as one of the manipulated variables y, the increment or decrement $\Delta\theta ig$ of the ignition timing $\theta ig$ is determined in accordance with the value of $\Delta x$, so that the ignition timing $\theta ig$ is adjusted and controlled to reduce the difference $\Delta x$ between the current and target values of the parameter x. When the amount of intake air Qa through the bypass valve 7 is selected as one of the manipulated variables y, it is controlled in a similar manner such that the same difference Δx is reduced; namely, the intake air amount Qa is increased when the value of the parameter x is to be increased; it is decreased when the value of the parameter x is to be decreased.

However, with regard to the intake air amount Qa the following point should be noted: In the case of the above embodiment, the amount of intake air Qa is controlled by means of the bypass valve 7; however, the intake air amount Qa can be controlled effectively by the bypass valve 7 only when the opening degree $\alpha$ of the throttle valve 4 is small. Thus, in the case where the control of the parameter x over a wide range of the intake air amount Qa is desirable, the opening degree $\alpha$ of the throttle valve 4 itself should be controlled instead of that of the bypass valve 7.

Further, as shown in FIGS. 8 and 9, the parameter x has a maximum with respect to the manipulated variables Ti and $\theta$ig and begins to decrease when the value of the manipulated variable exceeds the point corresponding to the maximum; in addition, misfiring or knocking may result when Ti or $\theta$ig is varied over a too wide range. Thus, the control range of the parameter x which can be effected by the adjustemnt of Ti or $\theta$ig alone is limited; hence, the combined control of both variables Ti and $\theta$ig is preferred when Ti and $\theta$ig are selected as one of the manipulated variables.

The above method of operation of the control means 19*e* may be summarized as represented within the block 19*c* in FIG. 3: the subtractor means 19*d* calculates the difference between the current and target values of the parameter x:

$$\Delta x = xT - x$$

The control element 19*e* determines, on the basis of the above difference Δx and the relationship between the increment Δy of the manipulated variable or variables y and the variation of the parameter x (the relationship being such as that represented in FIG. 8 or 9), the increment or decrement Δy of the manipulated variable which reduces the above difference Δx to zero. The relationship between the manipulated variable y and the parameter x (such as that represented in FIG. 8 or 9) is stored in the ROM 194 to be read out therefrom.

Figure 7:
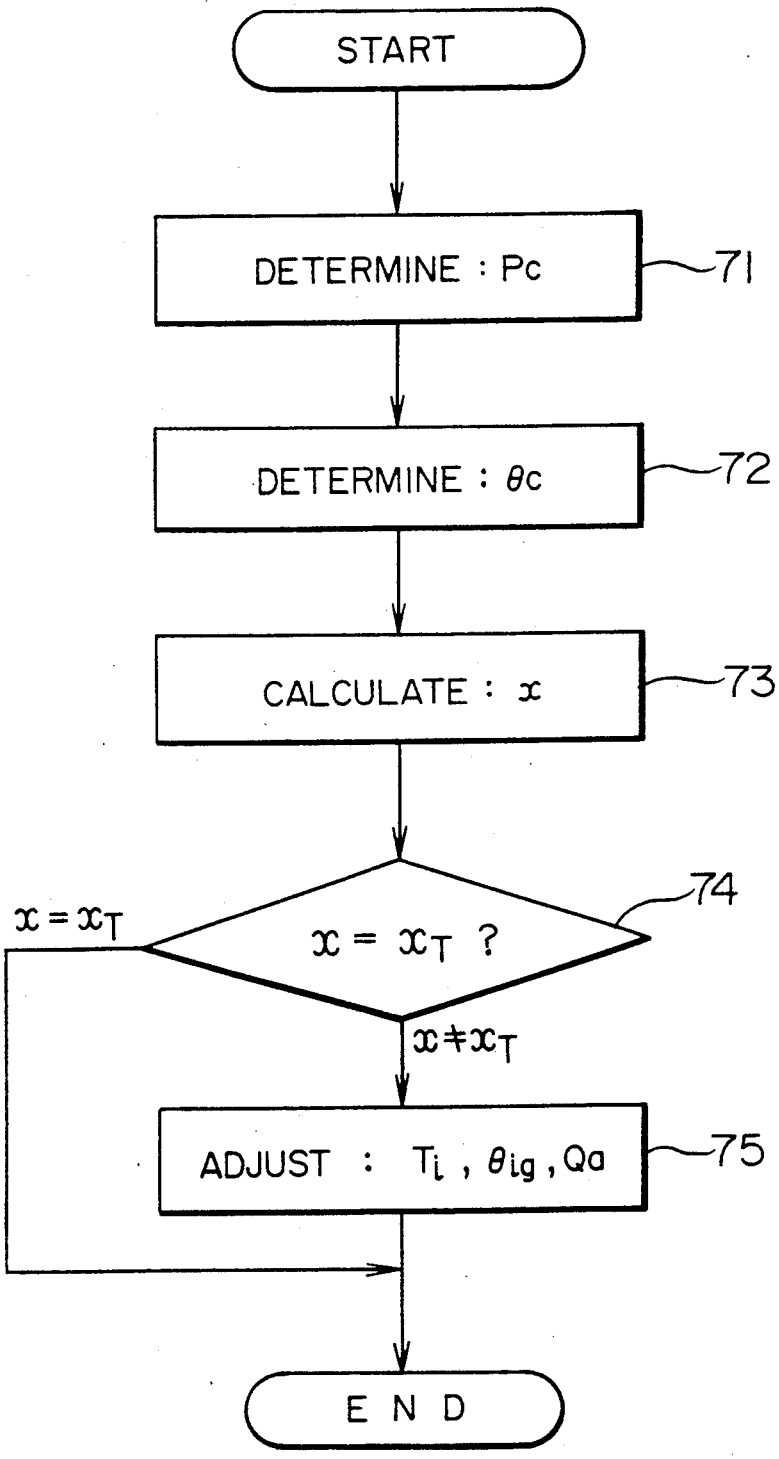
FIG. 7 shows a routine for determining the current value of the parameter x and for adjusting the manipulated variables.

The routine followed by the means 19*a* and 19*c* of the control device 19 in determining the current value of the parameter x and adjusting the manipulated variables y is shown in FIG. 7. First, in the steps 71 through 73, the current value of the parameter x is determined by the means 19*a*: at step 71, the combustion pressure Pc is read out from the sensor 16 and its value is determined; at step 72, the crank angle $\theta$c is determined from the output signal of the crank angle sensor 15; next, at step 73, the current value of the parameter x, namely, Pmax, Pi, A, or B, as discussed above, is calculated. Incidentally, when the value of A or B is to be calculated, the amount of intake air of the engine per stroke: Qa/N, or the value of the intake air pressure Pb must be determined; thus, the routine would comprise steps not shown in the figure for determining these values. Further, at steps 74 and 75, the adjustment of the manipulated variable(s) y (which comprises at least one of Ti, $\theta$ig, and Qa) is effected by the control means 19*c*; namely, at step 74, it is decided whether the current value x is equal to the target value $x_T$ or not; if the decision at step 74 is in the affirmative, the routne ends; on the other hand, if it is in the negative, the adjustment of the manipulated variable(s) y is effected at step 75 as described above.

While description has been made of the particular embodiment of this invention, it will be understood that many modifications may be made without departing from the spirit thereof; the appended claims are contemplated to cover any such modifications as fall within the true spirit and scope of this invention.

What is claimed is:

1. A control device for an internal combustion engine including means for controlling an amount of fuel supplied to a cylinder of the engine, said control device comprising:

combustion pressure sensor means (16) for detecting a combustion pressure (Pc) within the cylinder of the internal combustion engine;

current parameter value calculating means (19*a*), coupled to an output of said combustion pressure sensor means, for calculating a current value (x) of a parameter indicative of the magnitude of an output power of the internal combustion engine on the basis of the combustion pressure detected by said combustion pressure sensor means;

target parameter value calculating means (19*b*) for continuously determining a variable target value ($x_T$) of said parameter in accordance with a transient state of acceleration or deceleration of the internal combustion engine; and control means (19*c*) coupled to said current and target parameter value calculating means, for continuously adjusting a value of a manipulated variable (y) so as to reduce a difference between said current and target values of said parameter, said manipulated variable including at least one of: an amount of supplied fuel (Ti), an ignition timing ($\theta$ig), and an amount of intake air (Qa), of the internal combustion engine, wherein said target parameter value calculating means determines the target value of said parameter in accordance with a temporal rate of change of a variable selected from a group consisting of a degree of opening ($\alpha$) of a throttle valve of the internal combustion engine and an amount of intake air (Qa) supplied to the internal combustion engine.

2. A control device as claimed in claim 1, wherein said parameter is a mean effective pressure (Pi) of said combustion pressure during each cycle within the cylinder of the internal combustion engine.

3. A control device as claimed in claim 1, wherein said parameter is a maximum value (Pmax) of said combustion pressure during each cycle within the cylinder of the internal combustion engine.

4. A control device as claimed in claim 1, wherein said parameter is given by:

$$Pi/Q$$

wherein Pi is a mean effective pressure of said combustion pressure during each cycle within the cylinder of the internal combustion engine and Q is a value corresponding to an amount of intake air per stroke of the internal combustion engine.

* * * * *